United States Patent [19]

Rath

[11] Patent Number: 4,718,197

[45] Date of Patent: Jan. 12, 1988

[54] MODULAR INDUSTRIAL BLADE GRINDING AND HONING MACHINE

[76] Inventor: Hans M. Rath, P.O. Box 3108, Staunton, Va. 24401

[21] Appl. No.: 875,606

[22] Filed: Jun. 18, 1986

[51] Int. Cl.[4] ..... B24B 3/36

[52] U.S. Cl. ..... 51/5 D; 51/80 BS; 51/81 BS; 51/267; 51/285; 474/86

[58] Field of Search ..... 51/3, 5 D, 74 BS, 80 R, 51/80 A, 80 BS, 80 B, 81 R, 81 BS, 83 BS, 84 BS, 85 BS, 87 R, 87 BS, 266, 267, 285; 76/82, 86, 112, DIG. 8, DIG. 9; 474/86, 88

[56] References Cited

U.S. PATENT DOCUMENTS

| | | | |
|---|---|---|---|
| 1,902,010 | 3/1933 | Anderson | 51/80 A |
| 2,290,964 | 7/1942 | Hill | 51/80 B |
| 2,692,457 | 10/1954 | Bindszus | 51/206 R X |
| 2,709,874 | 6/1955 | Delafontaine | 51/80 B |
| 3,977,126 | 8/1976 | Hohler et al. | 51/5 D |
| 4,038,782 | 8/1977 | Cozzini | 51/80 BS X |
| 4,447,158 | 5/1984 | Simon | 474/88 X |

FOREIGN PATENT DOCUMENTS

| | | | |
|---|---|---|---|
| 54714 | 7/1950 | France | 51/74 BS |

*Primary Examiner*—Robert P. Olszewski

*Attorney, Agent, or Firm*—Brady, O'Boyle & Gates

[57] ABSTRACT

A heavy duty modular blade strip grinding and honing machine is disclosed. The modular machine is constructed with a required number of grind and hone/-strop stations, each having an A-frame base anchored to an underlying concrete mass having a coolant drainage system common to the several stations of the machine. Right and left hand grind stations and each hone/strop station include the same precision infeed mechanisms for the grinding wheels and the spiral interlocked honing wheels. Each grind station also includes a reciprocating diamond dressing wheel for the face of the grinding wheel at such station. Each hone station also includes a self compensating belt drive which eliminates all backlash and chatter in the honing wheels.

25 Claims, 20 Drawing Figures

MODULAR INDUSTRIAL BLADE GRINDING AND HONING MACHINE

BACKGROUND OF THE INVENTION

1. Field of the Invention

The present invention relates to a modular vibration-resistant industrial blade grinding and honing machine.

2. Description of the Prior Art

The prior patented art typified by expired U.S. Pat. No. 2,164,959 discloses machines for sharpening blade strip stock including grinding and honing wheels. U.S. Pat. No. 4,038,782 discloses a honing machine having interlocking honing wheels and gear belt drive means, broadly speaking. U.S. Pat. No. 1,773,679 discloses a grinding wheel unit which can pivot relative to a workpiece and being movable along a linear path relative to the workpiece. Other prior art grinding and honing machines are shown in expired U.S. Pat. Nos. 1,902,010 and 2,692,457.

SUMMARY OF THE INVENTION

The invention can be summarized as a modular precision grinding and honing machine for industrial blade strips of various sizes. Right and left hand grinding stations and one or more hone/strop stations are included in the modular machine as need dictates. Each machine station includes a separate A-frame base anchored in concrete so as to be highly resistant to vibration and extremely stable. Each grinding station includes on one side of its A-frame base a height and angle adjustable grinding wheel, wheel drive motor and automatic infeed high resolution stepping motor and associated loaded ball screw, all attached to a cross-roller slide carried by a pivot plate mounted on a bracket attached to one inclined side wall of the A-frame base. On its opposite side wall, the A-frame base carries another mounting bracket for the drive spindle of a vertical axis dressing wheel for the grinding wheel. A cross-roller slide for the dressing wheel allows the dressing wheel to reciprocate across the face of the grinding wheel under influence of a linear actuator, such as an air-hydraulic cylinder. A blade strip guide and coolant delivery system is mounted atop the A-frame base of each grinding station and each hone station of the modular machine.

Each hone station includes an A-frame base with mounting brackets on the opposite inclined side walls thereof for a pair of interlocking hone wheels each equipped with the same high resolution stepping motors and ball screws utilized for the grind stations. The hone wheels and their infeed components are held on cross-roller slides attached to pivot plates on the opposite side mounting brackets.

The hone wheel spindles are driven by a unique gear belt system including a drive motor and fixed and adjustable pulleys mounted within the hone station A-frame base with additional pulleys for the hone wheel spindles, their driving gear belts, and a belt tensioning system arranged exteriorly of one end wall of the hone station A-frame base. The gear belt drive for the hone wheels is soft and self-compensating to assure zero backlash in the interlocking hone wheels which is not attainable in a gear transmission.

A liquid coolant system for the modular machine delivers coolant to the grinding and hone wheels adjacent to the blade strip and returns the coolant to a drainage system provided in the concrete base which supports the A-frames of the several machine modules.

An object of the present invention is to provide a modular heavy duty industrial blade grinding and honing machine which can process blade strip stock up to two inches in width and 0.035 inch in thickness, as well as smaller widths and thicknesses.

Another object of the invention is to provide a machine which can grind and hone 100–120 feet per minute of blade strip based on the material removal for a standard industrial single edge blade strip.

Another object of the invention is to provide a modular blade strip grinding and honing machine which is compact in its construction, easy to maintain, and allows changing from one product strip to another in a minimum time, such as two hours or less, by a machine operator.

A further object is to provide a machine of the above-mentioned character in which the infeed of the grinding wheel is automatic and the infeed rate is of the order of 0.00001" per step of the high resolution stepping motor. The sam precision infeed for the hone wheels at the hone stations is under push button control by an operator.

A further object of the invention is to provide a blade strip grinding and honing machine which will include an electrical control panel. The control panel can be located in a floor-mounted console or in an overhead enclosure. The control panel will contain all of the electric motor starters and controllers as well as the electronic infeed components. The control panel will also contain all of the operator's start-stop controls and the manual infeed controls for the hone wheels which are push button operated. The grinding wheels will infeed automatically on a timed cycle. The control panel and its components are state of the art elements which need not be illustrated or described in detail in this application.

Other features and objects of the invention will become apparent to those skilled in the art during the course of the following detailed description.

BRIEF DESCRIPTION OF THE DRAWING FIGURES

DETAILED DESCRIPTION

Figure 1:
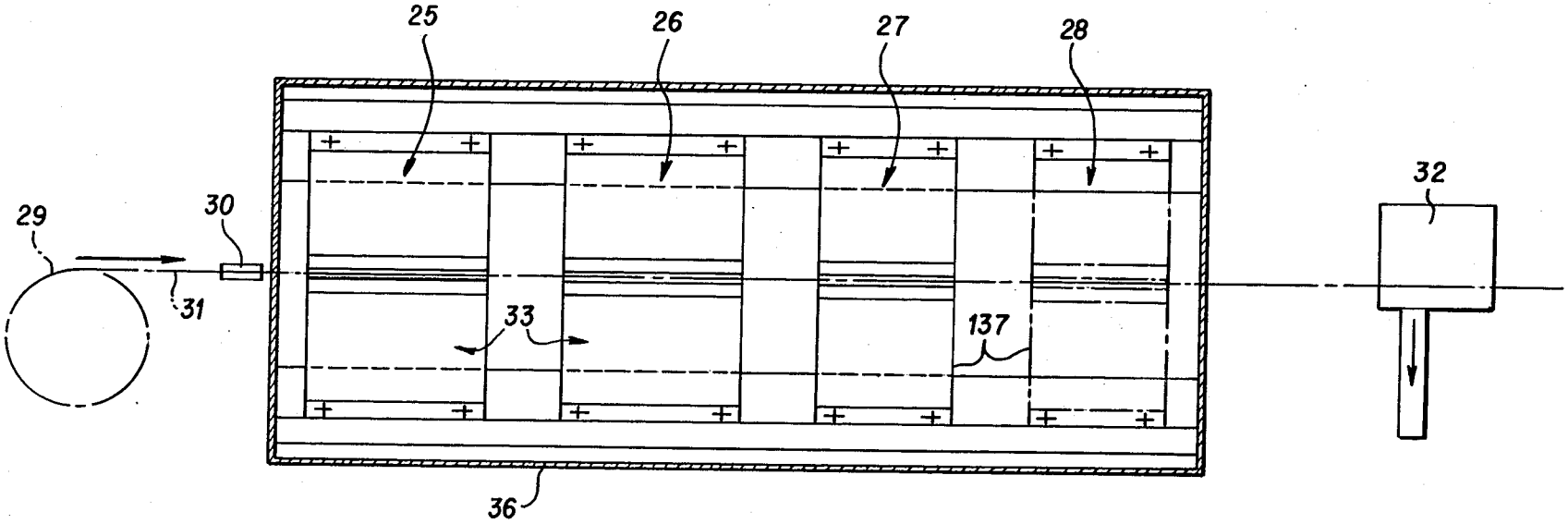
FIG. 1 is a schematic plan view of a modular blade strip grinding and honing machine according to the present invention.
Figure 2:
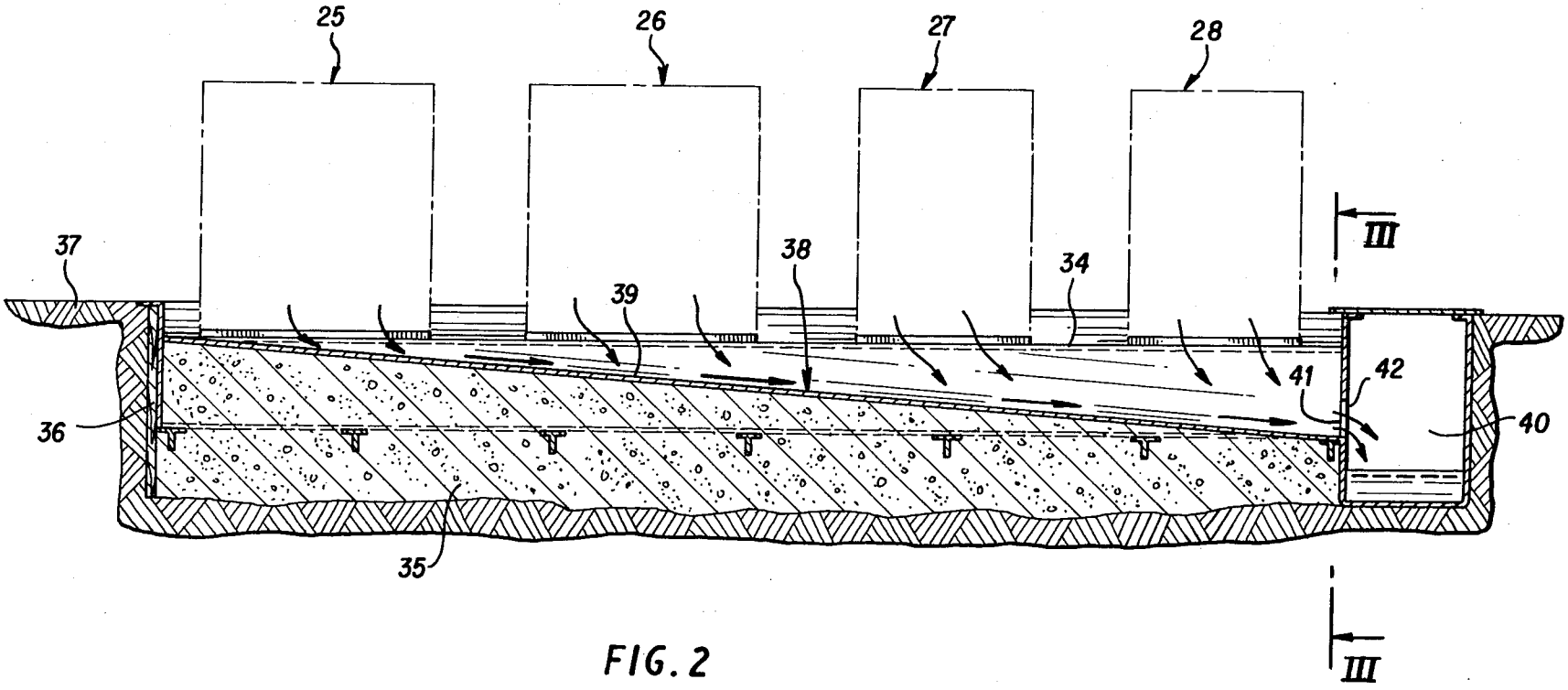
FIG. 2 is a partly schematic side elevation of the machine with its concrete base and coolant drainage system shown in vertical section.

Referring to the drawings in detail wherein like numerals designate like parts, a grinding and honing machine according to the present invention in its entirety is illustrated in FIGS. 1 and 2 of the drawings. The machine is modular in nature and typically may include right and left hand blade strip grind stations 25 and 26 followed by two hone stations 27 and 28. In some cases, the machine may include a single hone station only or a hone station followed by a strop station, depending on need. The number of machine modules is variable and hence the machine is highly versatile in its ability to grind and hone, or hone/strop, industrial blade strip stock in various widths and thicknesses, as previously noted.

As shown in FIG. 1, the modular machine at the upstream end thereof includes a blade strip decoiler 29, followed by a conventional detector 30 of excessive blade thickness. At the downstream end, the ground and honed blade strip 31 is received by a conventional blade breaker 32 which sends the individual sharpened blades to a suitable collection point.

Figure 3:
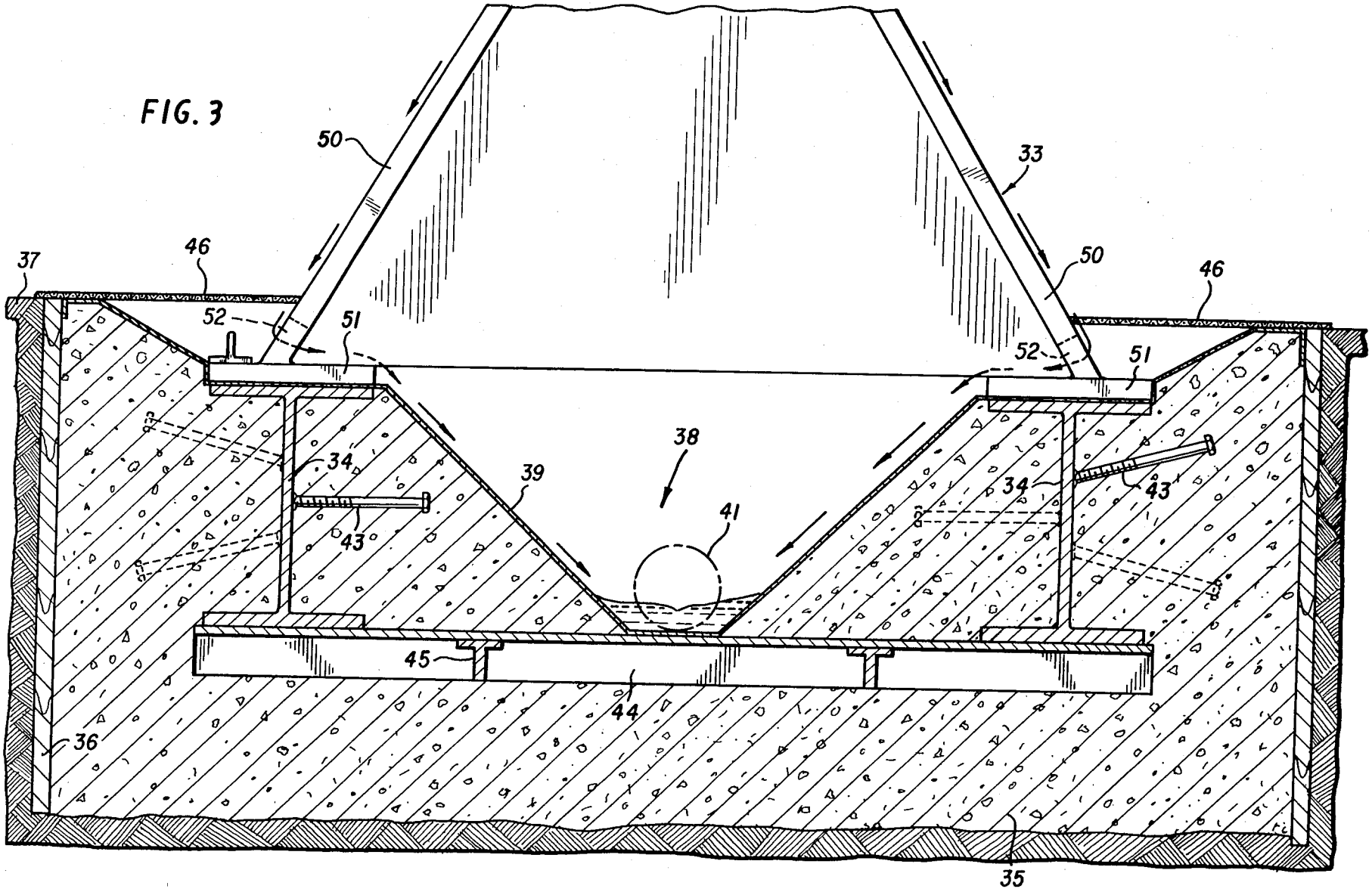
FIG. 3 is an enlarged transverse vertical section taken on line III—III of FIG. 2.

As shown in FIGS. 2 and 3, the machine modules each of which includes a sturdy A-frame 33 rest on spaced parallel I-beams 34 which are embedded in a concrete mass 35 held in a wooden casing or form 36. The concrete mass and its wooden casing are recessed into the existing floor 37 which extends beyond opposite sides of the machine.

A feature of the invention is the provision of a longitudinally sloping return trough 38 for liquid coolant having a preferably stainless steel lining 39. This trough is depressed into the concrete mass 35 which extends beneath all of the machine modules 25–28. At its deeper outlet end, the inclined trough 38 communicates with a main coolant discharge trough 40 through a suitable opening 41 equipped with a strainer 42.

As shown in FIG. 3, the I-beams 34 may carry additional anchor elements 43 embedded in the concrete mass 35 and both longitudinal and transverse T-bars 44 and 45 are preferably welded to the bottoms of the I-beams 34 for increased rigidity.

The combination of the A-frames 33 of the machine modules and the underlying beams 34 embedded in the concrete mass 35 render the machine extremely stable and almost totally resistant to vibrations during operation, which in turn promotes the highest degree of precision in the grinding and honing, or hone/stropping, of the moving blade strip 31.

Suitable gratings 46 a floor level for the support of workers on opposite sides of the modular machine are provided, as shown.

Figure 17:
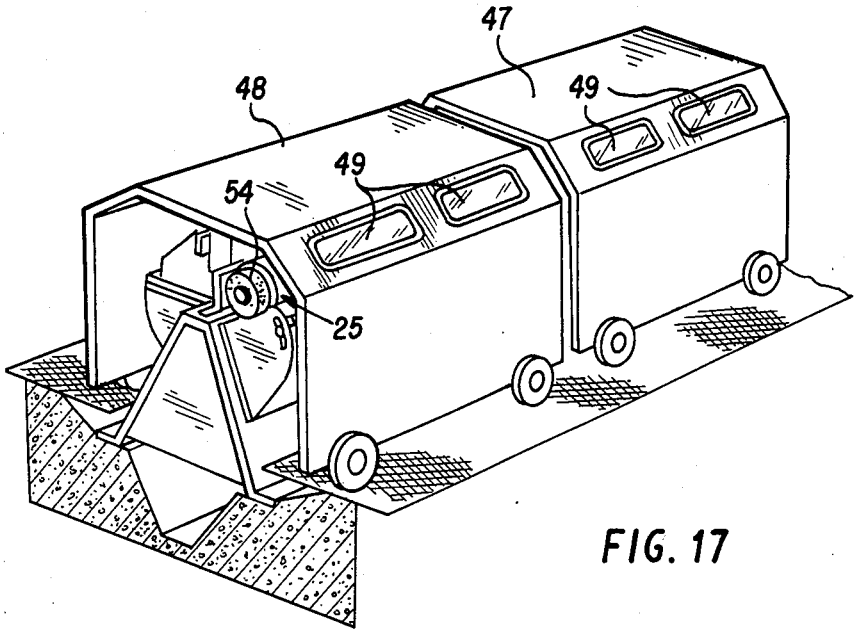
FIG. 17 is a perspective view, on a reduced scale, showing a telescoping coolant splash guard for the grinding and honing machine.
Figure 11:
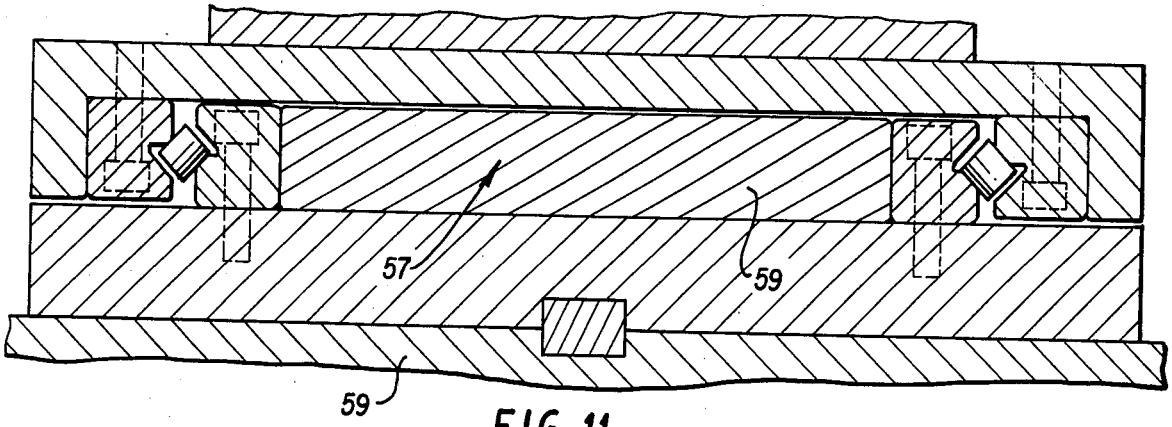
FIG. 11 is an enlarged vertical section taken substantially on line XI—XI of FIG. 4.
Figure 16:
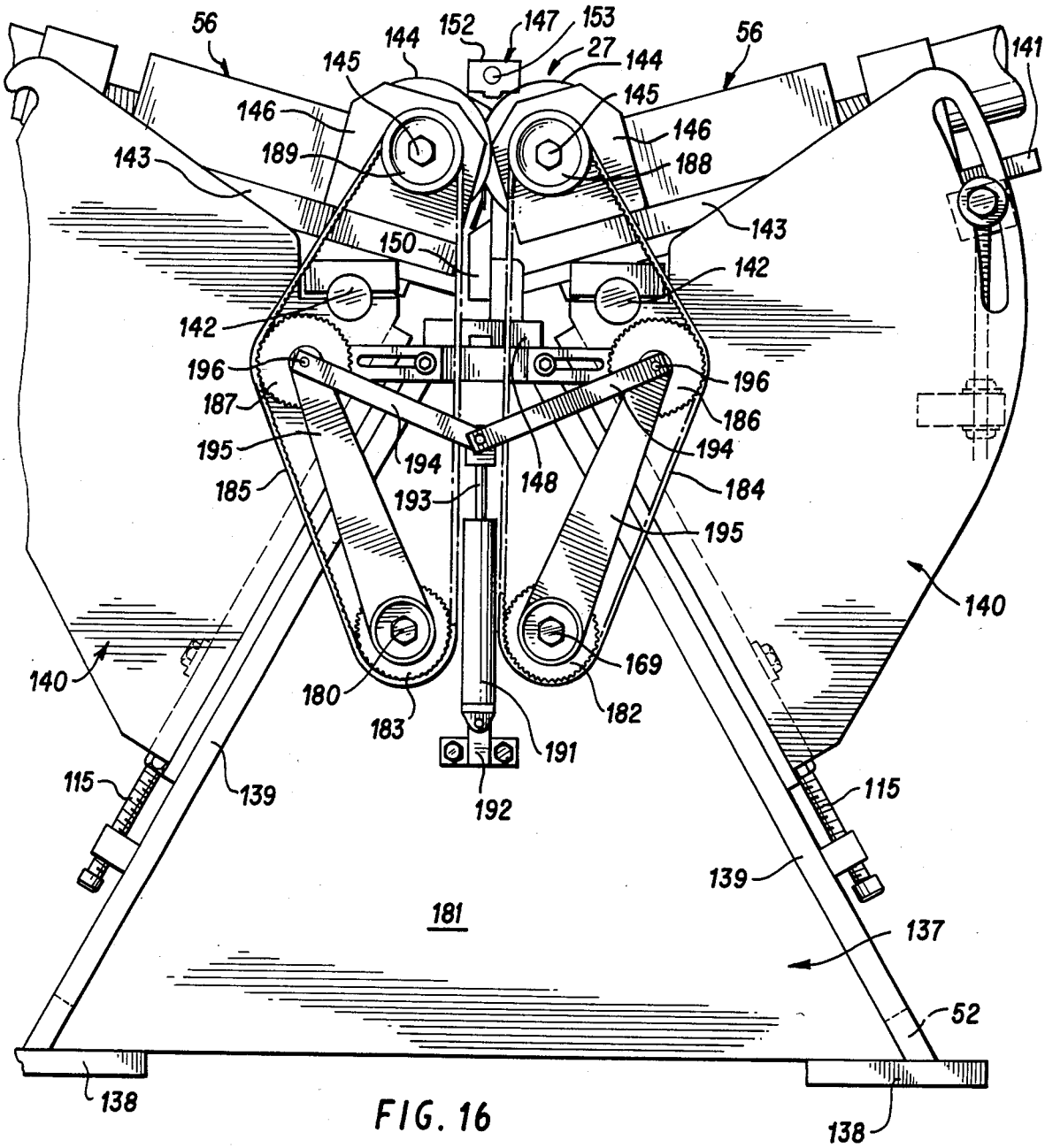
FIG. 16 is an opposite end elevation of the hone station module.

As shown in FIG. 17, the modular machine is preferably straddled by wheeled telescoping coolant splash guards 47 and 48 having viewing windows 49. Other types of coolant splash protection could be utilized, if preferred.

Figure 4:
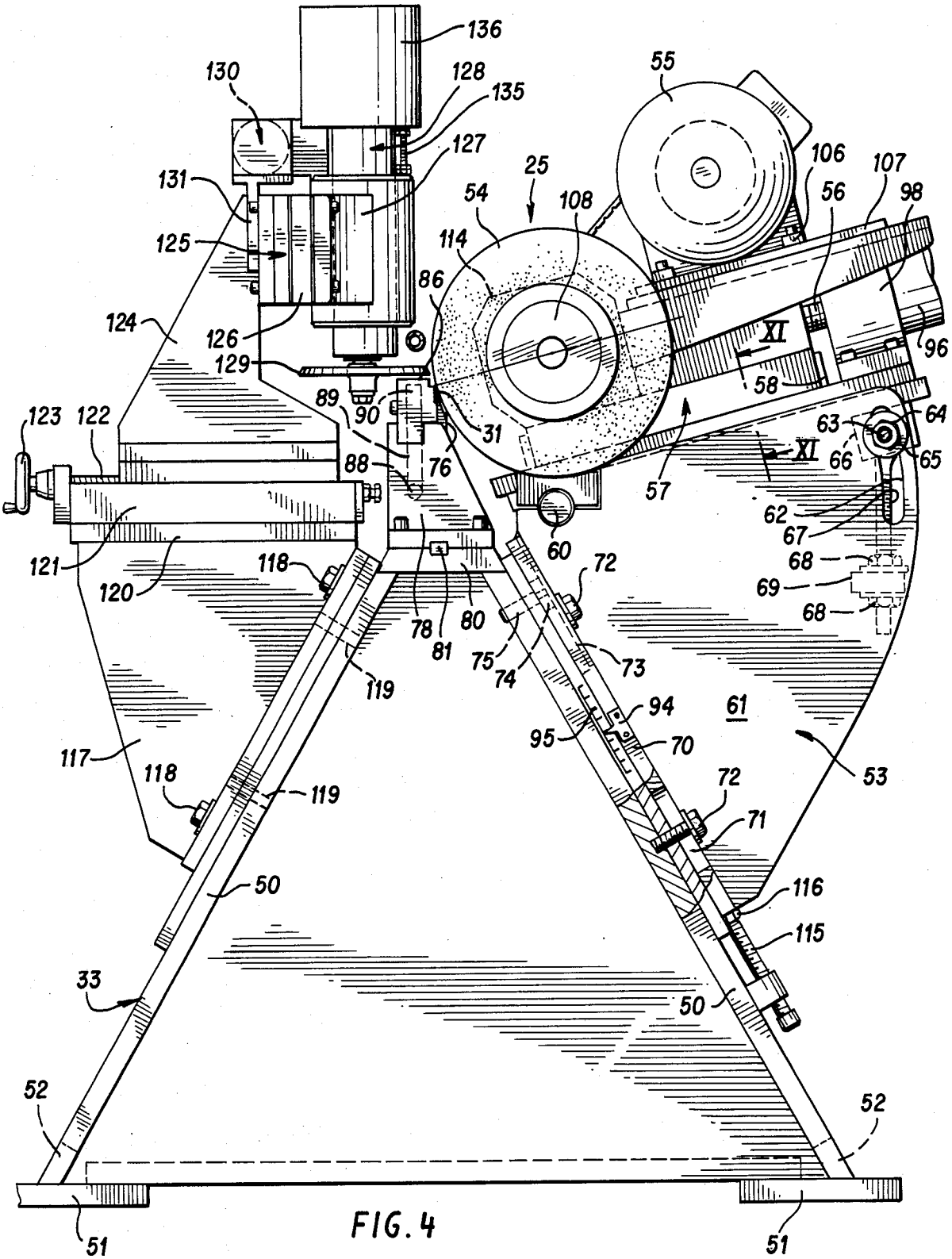
FIG. 4 is an end elevation of a grind station machine module, partly in section.
Figure 5:
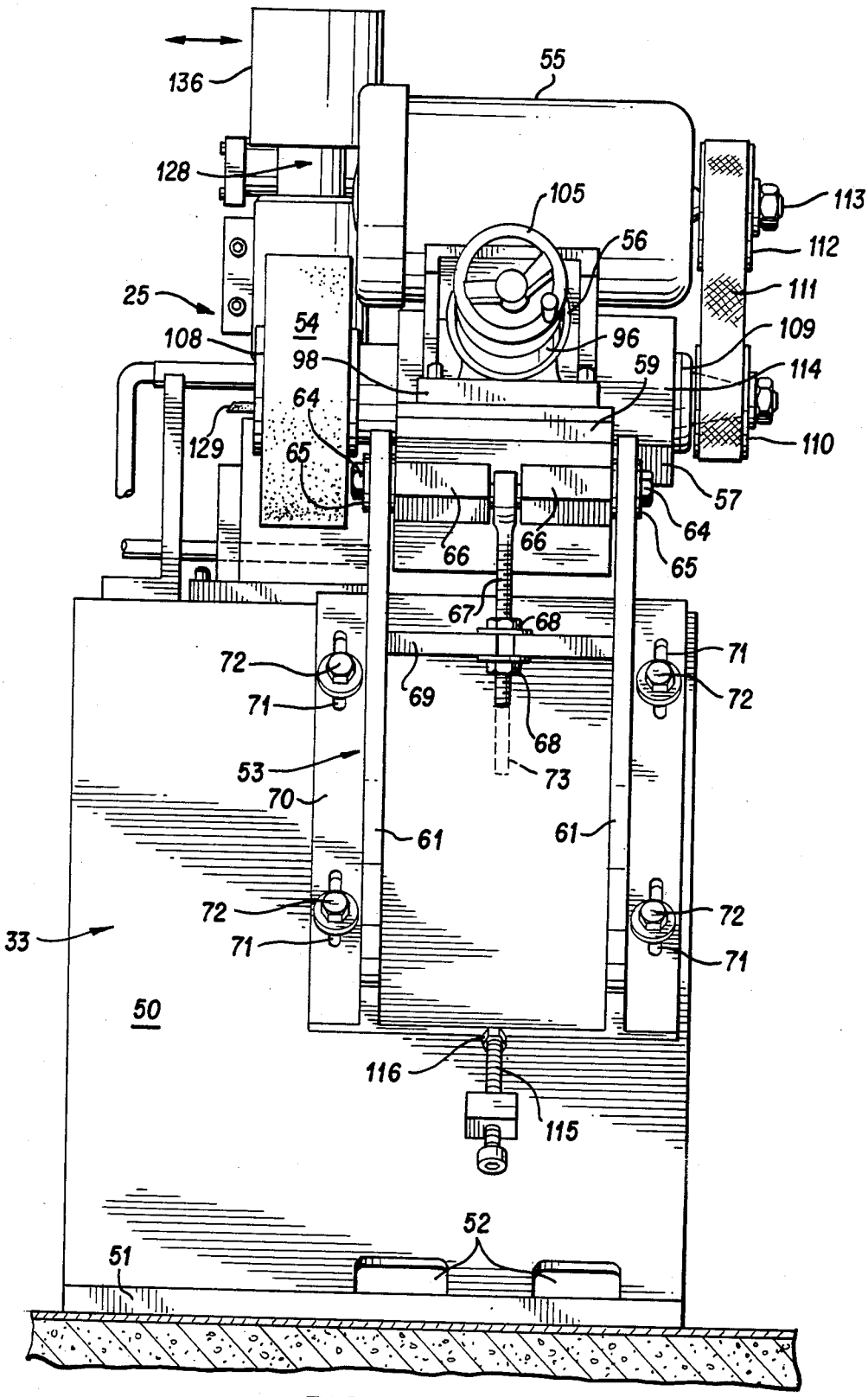
FIG. 5 is a side elevation of the grind station module shown in FIG. 4.

The right hand grind station module 25, including its A-frame 33, is shown in detail in FIGS. 4 and 5 of the drawings. A detailed description of the right hand grind station 25 will also serve to describe the left hand grind station module 26 which is identical to the right hand grind station except that the components thereof are reversed left-to-right in the manner of a mirror image.

The A-frame 33 of right hand grind station 25 includes opposite side upwardly converging walls 50 having level base plates 51 attached thereto and resting solidly on the I-beams 34 as best shown in FIG. 3. At their bottoms, the inclined side walls 50 have coolant drain openings 52 formed therethrough in communication with the sloping trough 38.

The right hand grind station includes a sturdy mounting bracket 53 for the right hand grinding wheel 54 which is typically a twelve inch diameter wheel having a five inch wide face. This grinding wheel, along with its drive motor 55 and its automatic infeed means 56 and associated parts to be described, are all supported on a precision cross-roller slide 57 having a stationary component 58 attached to a pivoted plate 59 having opposite side trunnions 60. The pivoted plate 59 through its trunnions is pivotally attached to the mounting bracket 53 between two parallel vertical webs 61 of the mounting bracket 53. The webs 61 have arcuate slots 62 near their tops formed concentrically with the axes of the trunnions 60 and these slots receive the end portions of a cross-shaft 63 which are screw-threaded to receive locking nuts 64 engaging hardened washers 65.

The cross-shaft 63 is received through apertured lugs 66 on the bottom of pivot plate 59. A screw-threaded eye rod 67 has its head pivotally receiving the shaft 63 and has its threaded shank engaged by adjusting and locking nuts 68 on opposite sides of a fixed web 69 connected between the two vertical webs 61 of mounting bracket 53. By this means, the grinding wheel 54 and all associated parts on the pivot plate 59 are adjusted angularly relative to the blade strip 31 through a range of 15°. In FIG. 4, the pivot plate 59 is shown near the top limit of its adjustment.

The mounting bracket 53 is bodily adjustable upwardly and downwardly along the inclined side wall 50 of the A-frame 33 to thereby adjust the height of the grinding wheel 54 and associated elements. Toward this end, the base plate 70 of the mounting bracket 53 is provided on its opposite sides with adjusting slots 71 receiving clamping or locking screws 72 having threaded engagement with the adjacent inclined side wall 50 of the A-frame 33.

To provide greater precision in the upward and downward adjustment of the bracket 53, a keyway 73 is formed in its base plate 70 at the center of the bracket 53, and a guiding key 74 for the bracket 53 engages in the keyway 73 and is fixed by a dowel 75 relative to the wall 50. It may be seen that the grinding wheel 54 can be adjusted vertically and angularly relative to the blade strip 31.

The blade strip 31 is engaged with a vertical guide plate 76 secured by screws 77 to a mounting bracket 78, in turn fixed by screws 79 to a top horizontal plate 80 of the A-frame 33. A key 81 is utilized to properly align the blade strip mounting bracket 78 with the A-frame top plate 80. The blade strip 31 is backed up by a carbide rail 82, FIG. 7, and a lower edge carbide seating rail 83 for the blade strip is contained in a block 84 along with the rail 82, the block being secured by screws 85 to a coolant distribution manifold 86 atop the mounting bracket 78. The manifold 86 is anchored to the bracket 78 by additional screws 87 as best shown in FIG. 8.

Liquid coolant enters the mounting bracket 78 through a horizontal passage 88, FIG. 4, opening through one end of the bracket 78 and communicating with a plurality of spaced vertical coolant channels 89 formed in the bracket 78. These channels 89 communicate with a corresponding number of coolant channels 90 leading upwardly through the manifold 86 and communicating with a corresponding number of horizontal coolant outlet passages 91 which direct the coolant onto the face of the grinding wheel 54 immediately above the blade strip 31.

Figure 7:
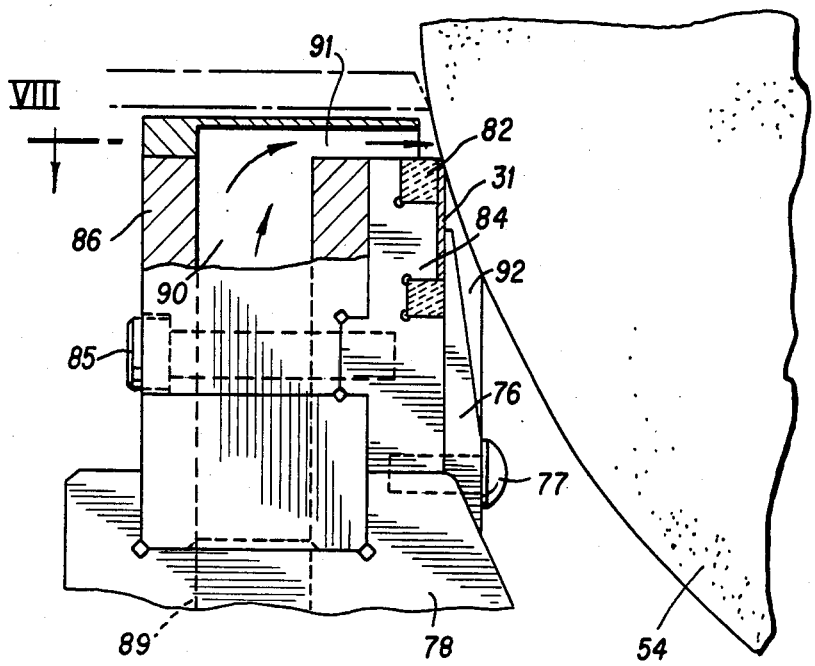
FIG. 7 is an enlarged fragmentary vertical section taken on line VII—VII of FIG. 8.
Figure 8:
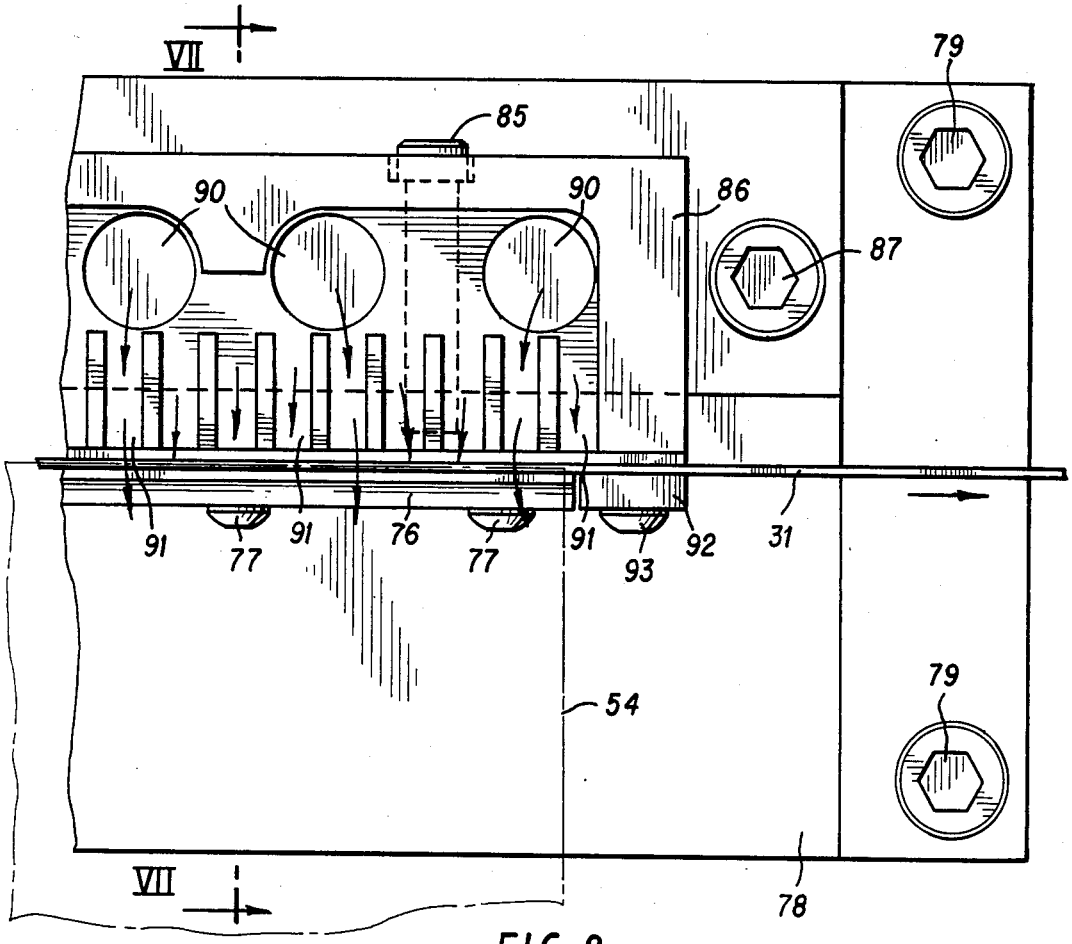
FIG. 8 is a fragmentary horizontal section taken on line VIII—VIII of FIG 7.

As shown in FIG. 7, the upper tip of the guide plate 76 terminates well below the top edge of the strip 31, and at the opposite ends of the plate 76, the blade strip is further supported by guide bars 92 whose tops extend adjacent to the top edge of the blade strip 31. The guide bars 92 straddle the opposite end faces of the grinding wheel 54.

The blade strip 31 shown in FIG. 7 is a ¾" wide strip. In the case of a wider blade strip, the lower edge seating rail 83 will be at a lower elevation on the block 84, and it should be borne in mind that the machine can accommodate blade strips up to two inches wide, as previously described. The guide bars 92 are secured by additional screws 93, as best shown in FIG. 8.

A pointer 94 on the mounting bracket 53 is preferably provided to coact with a linear measuring scale 95 on an adjacent part of the A-frame 33 so that the height adjustment of the grinding wheel 54 can be visually indicated.

Figure 6:
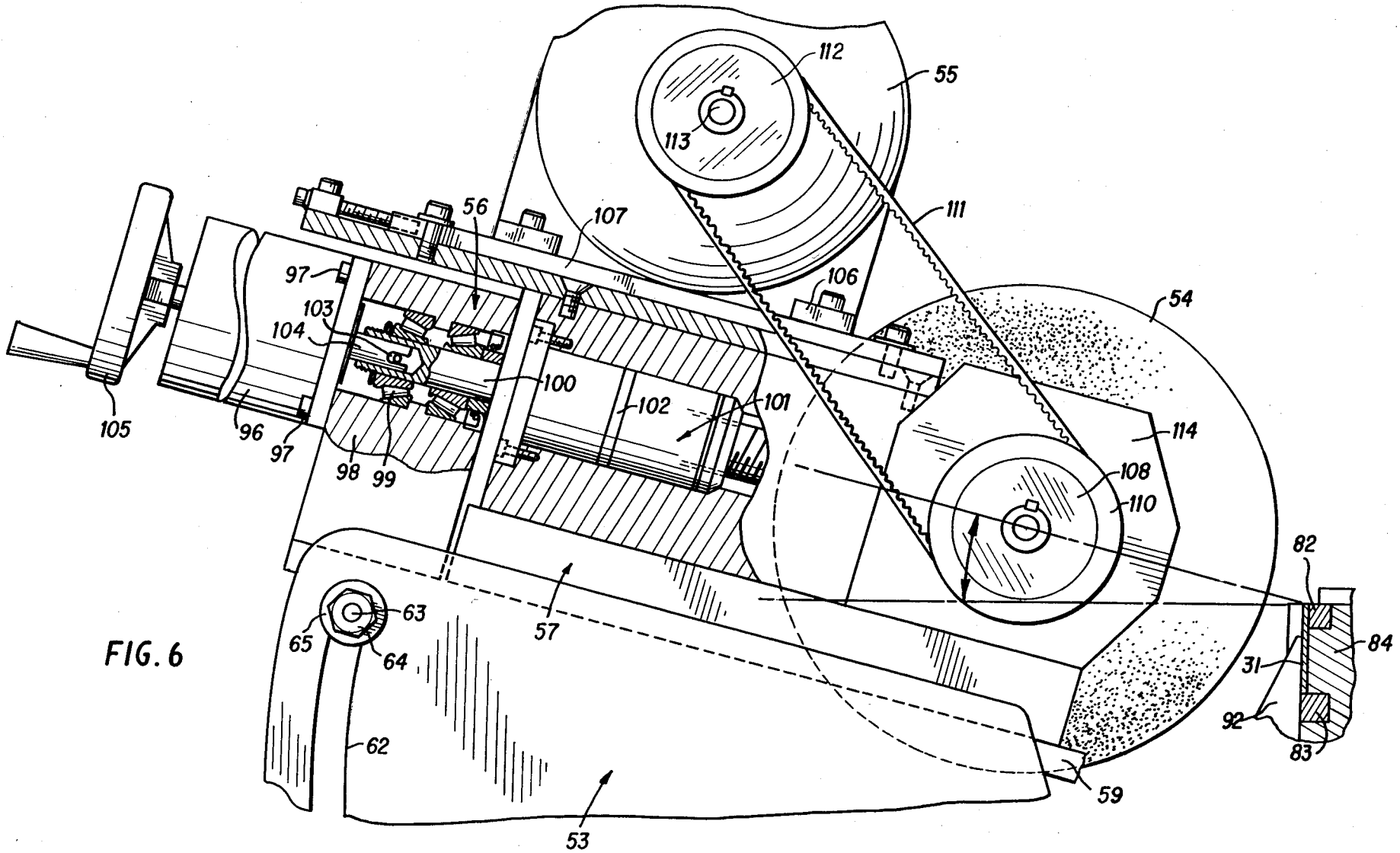
FIG. 6 is an enlarged fragmentary end elevation of the grind station module with the grinding wheel automatic infeed mechanism and the blade strip and its guide being shown partly in vertical cross section.

The previously-mentioned automatic infeed means 56 for the grinding wheel 54 is shown in some detail in FIG. 6. This means comprises a high resolution stepping motor 96 capable of 25,000 steps per revolution maximum. Such a motor is manufactured by Compumotor Corp. of California, No. M 106-178 700 oz. in. torque or an equivalent stepping motor. The stepping motor 96 is attached at 97 to a bearing support 98 containing roller bearings 99 for the support of a shaft extension 100 of a conventional preloaded ball screw 101 having a spacer 102. The ball screw 101 is preferably a THK ball screw or equivalent device and is a commercial shelf item. The shaft extension 100 is drivingly coupled by pin means 103 with a shaft extension 104 for stepping motor 96 as shown in FIG. 6.

The automatic infeed means 56 further includes a hand wheel 105 at its rear end by means of which the grinding wheel 54 can be manually retracted at a rate of ¼" per revolution in an emergency, or when changing the grinding wheel.

The bearing support 98 is attached to the pivot plate 59, FIG. 4, and extends above the same. The electric drive motor 55 for grinding wheel 54, preferably a fan-cooled 5 hp. motor for a grinding wheel of the size described, includes a base plate 106 attached to a motor mounting bracket 107. Also held on the cross-roller slide 57 along with the grinding wheel 54 and its holder 108, is a grinding wheel spindle 109, driven at one end by a pulley 110, in turn driven by belt 111 engaged with a drive pulley 112 on the shaft 113 of motor 55. The spindle 109 is held within a clamp device 114 fixed to the top of cross-roller slide 57. The motor mounting bracket 103 which overlies the bearing support 98 and preloaded ball screw and stepping motor 96 is attached to the clamp device 114 cantilever-fashion, as best shown in FIG. 4.

The cross-roller slide 57 and all parts mounted thereon including the grinding wheel 54 and its automatic infeed means 56 is raised and lowered with the mounting bracket 53 as a unit on the A-frame 33 by the operation of a single adjusting screw 115 mounted on the adjacent side wall 50 of the A-frame 33 and engaging a contact element 116 or button on the base plate of mounting bracket 53. When the precise elevation of the bracket 53 is set by operation of the adjusting screw 115, the several screws 72 are locked to fix the position of the bracket 53. The angular adjustment of the cross-roller slide 57 and all parts mounted thereon around the axes of trunnions 60 is accomplished by adjustment of the threaded eye rod 67 and its nuts 68. Following angular adjustment, the nuts 64 are securely tightened.

On the other side of the right hand grind station 25, FIG. 4, a fixed mounting bracket 117 is secured to the other side wall 50 of A-frame 33 by screws 118 and locator dowels 119. The mounting bracket 117 includes a level top plate 120 on which is held a dovetail slide 121 equipped with an operating shaft 122 having a hand wheel 123. Fixed atop the dovetail slide 121 is a support bracket 124 for a cross-roller slide 125 which operates horizontally in a vertical plane. The movable component 126 of the cross-roller slide 125 is secured to a mounting bracket 127 of a motorized vertical axis dressing wheel spindle 128, preferably a Setco motorized spindle Size 5, Type 2700.5-18½ hp. 1800 rpm.

Secured to and driven by the motorized spindle 128 at its lower end is a diamond dressing wheel 129 for dressing the face of grinding wheel 54 in a prescribed time cycle to prevent loading of the face of the grinding wheel, and to continuously present a clean and true wheel face to the moving blade strip 31. The diamond dressing wheel 129 is reciprocated horizontally on the movement axis of the cross-roller slide 125 by a horizontal axis air-hydraulic cylinder 130 whose cylinder body is fixed relative to the support bracket 124 by plates 131, and whose movable rod 132 is connected with another plate 133 secured at 134 to the movable component 126 of the cross-roller slide 125.

A fine height-adjusting screw 135 for the diamond dressing wheel 129 is provided between the mounting bracket 127 and the motor 136 of the motorized spindle 128.

As previously noted during the operation of the grind station 25, the infeed means 56 for grinding wheel 54 is automatic and the reciprocation of the dressing wheel 129 across the face of the wheel 54 occurs in a predetermined time cycle.

The left hand grind station 26 of the modular machine is the reverse or mirror image of the right hand grind station 25 and for this reason need not be described in detail, as previously mentioned.

The first hone or hone/strop station 27 of the machine comprises an A-frame 137 of somewhat lesser width between its vertical end walls than the A-frame 33 for the grind stations. The A-frame 137 has its base plates 138 attached to the eye beams 34 in the same manner as shown in FIG. 3.

On each inclined side wall 139 of the A-frame 137 there is mounted a pair of identical support brackets 140 which are similar in nature to the brackets 53. The mounting brackets 140 are adjustable vertically relative to the blade strip 31 in the exact manner previously described for the bracket 53 of the grind station.

A pivoted vertically swingable plate 141 having trunnions 142 is provided on each side of the hone station 27 substantially as described in connection with the pivot plate 59 at the grind station. The pivot plates 141 each mount a cross-roller slide 143 which is identical to the previously-described cross-roller slide 57. A pair of interlocked spiral honing wheels 144 at the honing station 27 are carried by parallel horizontal axis spindles 145 held in clamp devices 146 based on cross-roller slides 143. Substantially the identical infeed means 56 described for the grind station 25 is provided for the honing wheels 144 at the hone station 27 and the details of the infeed means need not be further described.

A difference between the grind and hone stations is that the honing wheels 144 are adjustable angularly on the axes of trunnions 142 through 30° compared to 15° angular adjustment for the grinding wheel 54.

Figure 13:
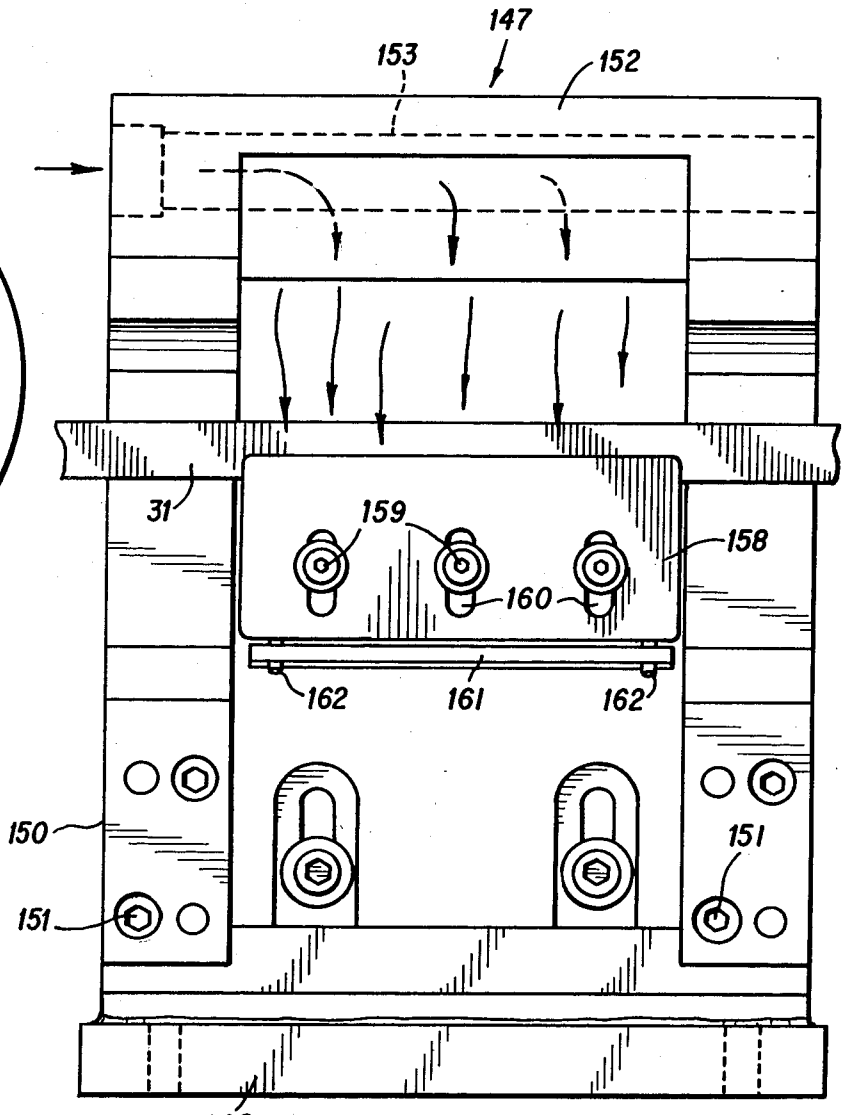
FIG. 13 is a side elevation of the blade strip guide and coolant discharge means at the hone station, parts omitted.
Figure 12:
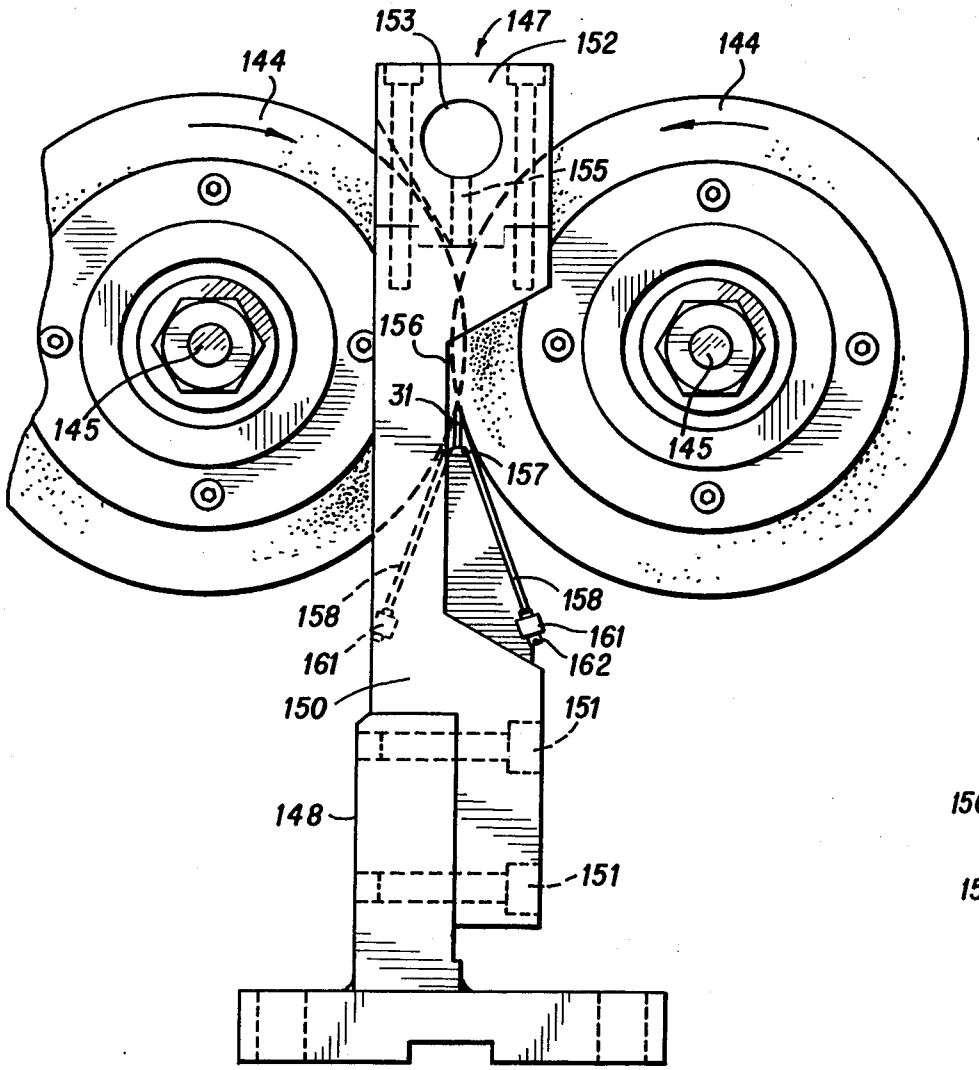
FIG. 12 is an end elevation of interlocking hone wheels and a blade strip guide and its support at a hone station module.
Figure 14:
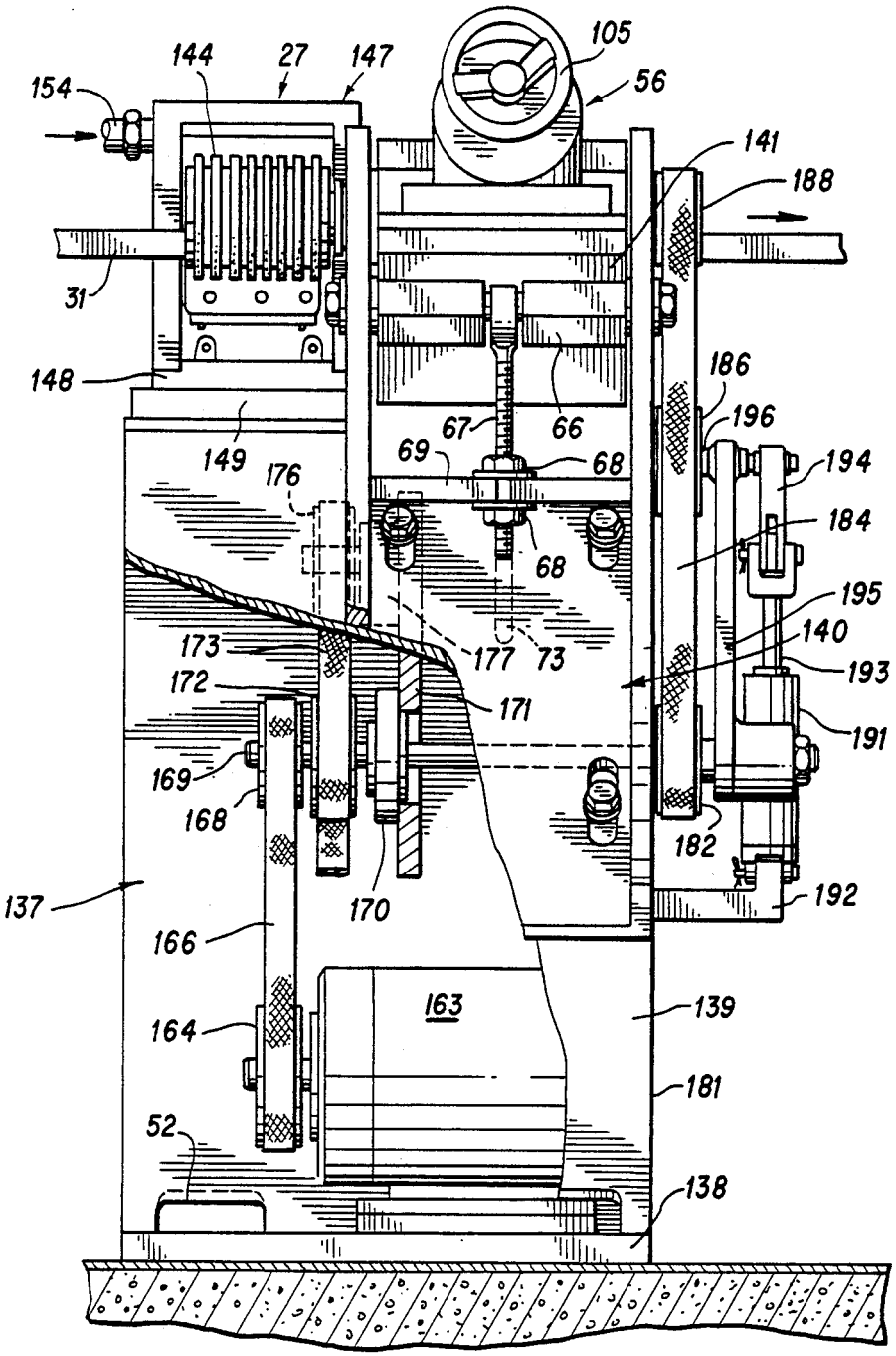
FIG. 14 is a side elevation of a hone station module of the machine, partly in section and partly broken away.
Figure 18:
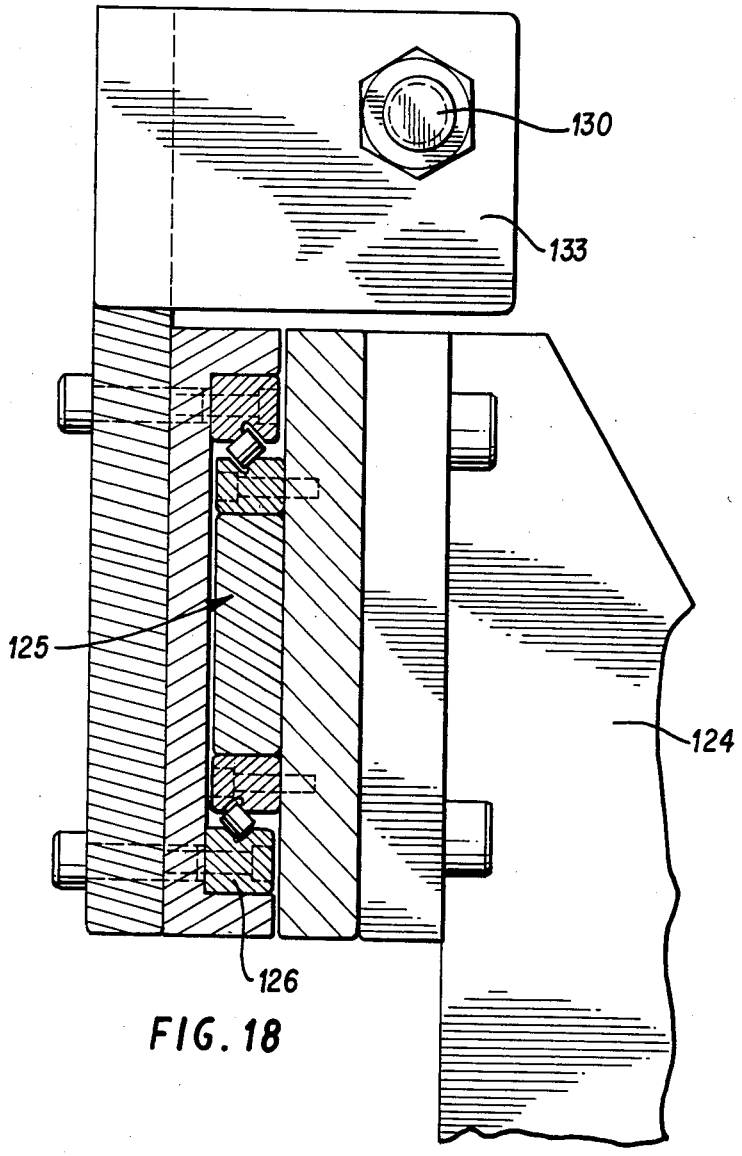
FIG. 18 is a fragmentary vertical section taken through a cross-roller slide and associated elements for the diamond dressing wheel at the grind station, on line XVIII—XVIII of FIG. 20.
Figure 19:
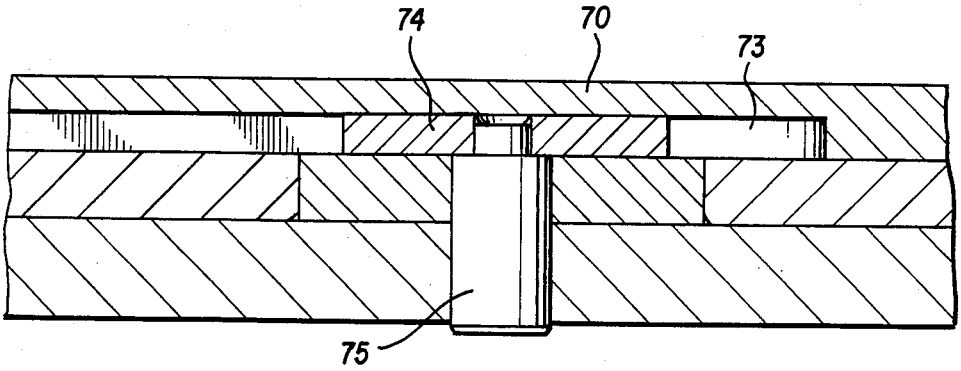
FIG. 19 is an enlarged vertical section showing a guide key, keyway and associated elements for a grinding wheel mounting bracket at the grind station.
Figure 20:
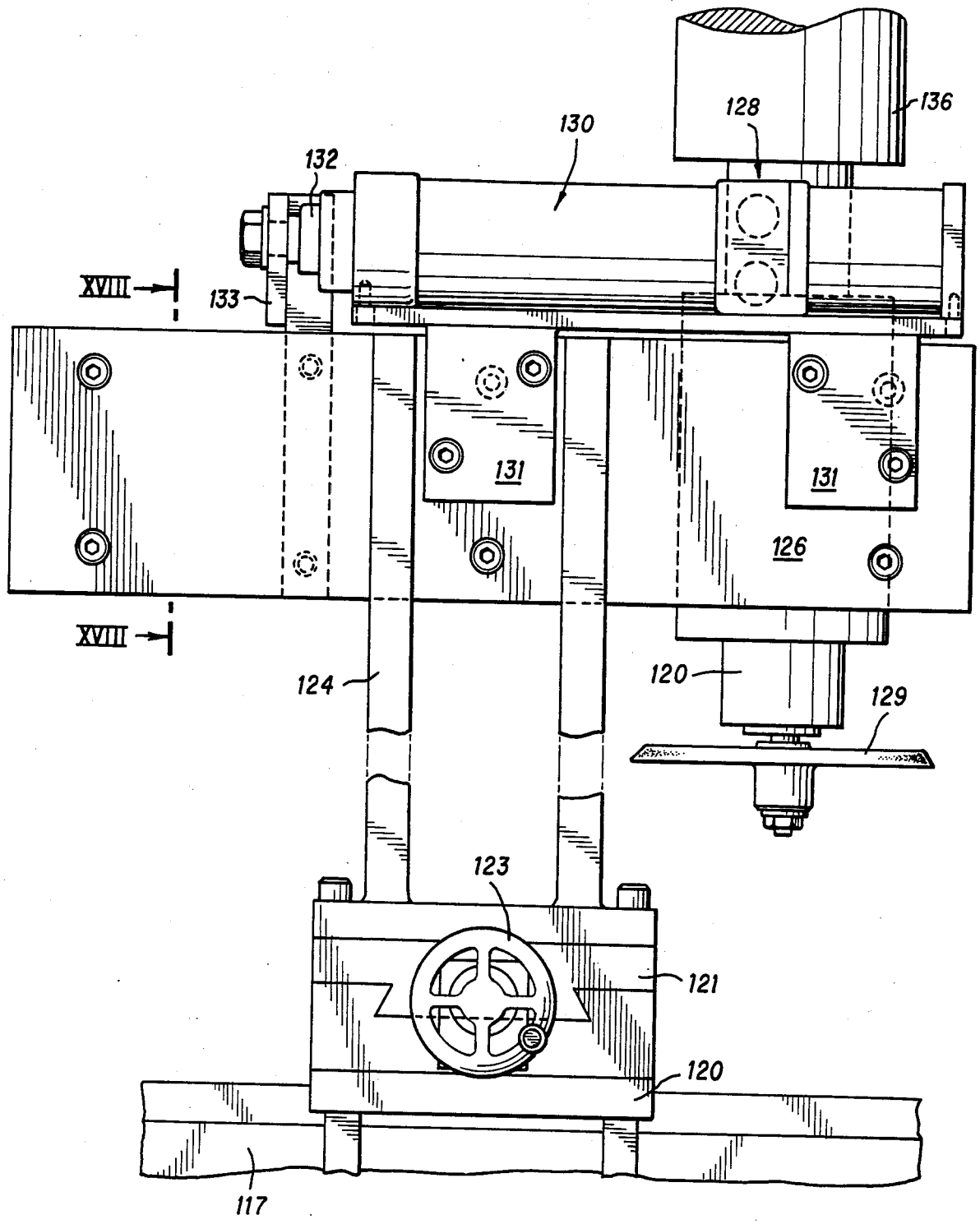
FIG. 20 is a fragmentary side elevation of a diamond dressing wheel, dressing wheel linear actuator and dovetail slide.

A blade strip guide and coolant delivery means 147 is provided at the hone station 27, this means comprising a support 148 fixed and keyed to a top plate 149 of the A-frame 137 adjacent to corresponding sides of the brackets 140, FIG. 14. A blade guide mount 150 is attached by screws 151 to the support 148 and to the top of this mount is fixed a coolant delivery manifold 152 having a horizontal coolant delivery passage 153 connected with a coolant pipe 154, FIG. 14. Plural descending coolant delivery ports 155 lead from the passage 153 and direct the coolant onto the top of the interlocked honing wheels 144, FIG. 12, directly above the blade strip 31. As shown in FIGS. 12 and 13, the guide mount 150 is a frame which allows the interlocked portions of the two honing wheels 144 to operate within the mount 150. The mount 150 is recessed along one side at 156 to clear the moving blade strip 31.

The lower edge of the blade strip 31 engages a horizontal element 157 and the opposite vertical faces of the blade strip pass between and are guided by plates 158 engaging inclined surfaces of the mount 150 and being retained by screws 159 engaging through adjusting slots 160 in the plates 158. Keys 161 on the mount 150 receive adjusting set screws 162 which engage the lower edges of the guide plates 158 so that the latter may be adjusted with precision and locked by the screws 159. A precision guideway for the blade strip 31 at the hone station is thus provided.

A very important feature of the invention resides in a self-compensating precision gear belt drive for the spindles 145 of the two interlocking honing wheels 144, whereby the latter counter-rotate in unison, as shown by the directional arrows in the drawings. As will be described, this unique belt drive means is located partly within the A-frame 137 at the hone station and partly outside of one end wall thereof, FIG. 14.

An electric drive motor 163, including a main drive pulley 164, is disposed inside of the A-frame 137 on the floor plate 165 thereof. The pulley 164 engages and drives a gear belt 166 which has teeth on the interior side thereof only to engage teeth of the pulley 164 and similar teeth of another pulley 168 on a fixed axis horizontal shaft 169 held by a bearing means 170 on an internal vertical web 171 of the A-frame 137.

Another pulley 172 on the shaft 169 behind the pulley 168, FIG. 14, engages and drives a gear belt 173 having teeth on both sides thereof. The belt 173 engages an adjustable idler pulley 174 held on a pivot bracket 175 attached to the web 171. From this point, the belt 173 passes around and drivingly engages an upper centrally located pulley 176 held on an adjustable support block 177 fixed to the web 171 by several screws 178 whose centers can be adjusted.

Figure 15:
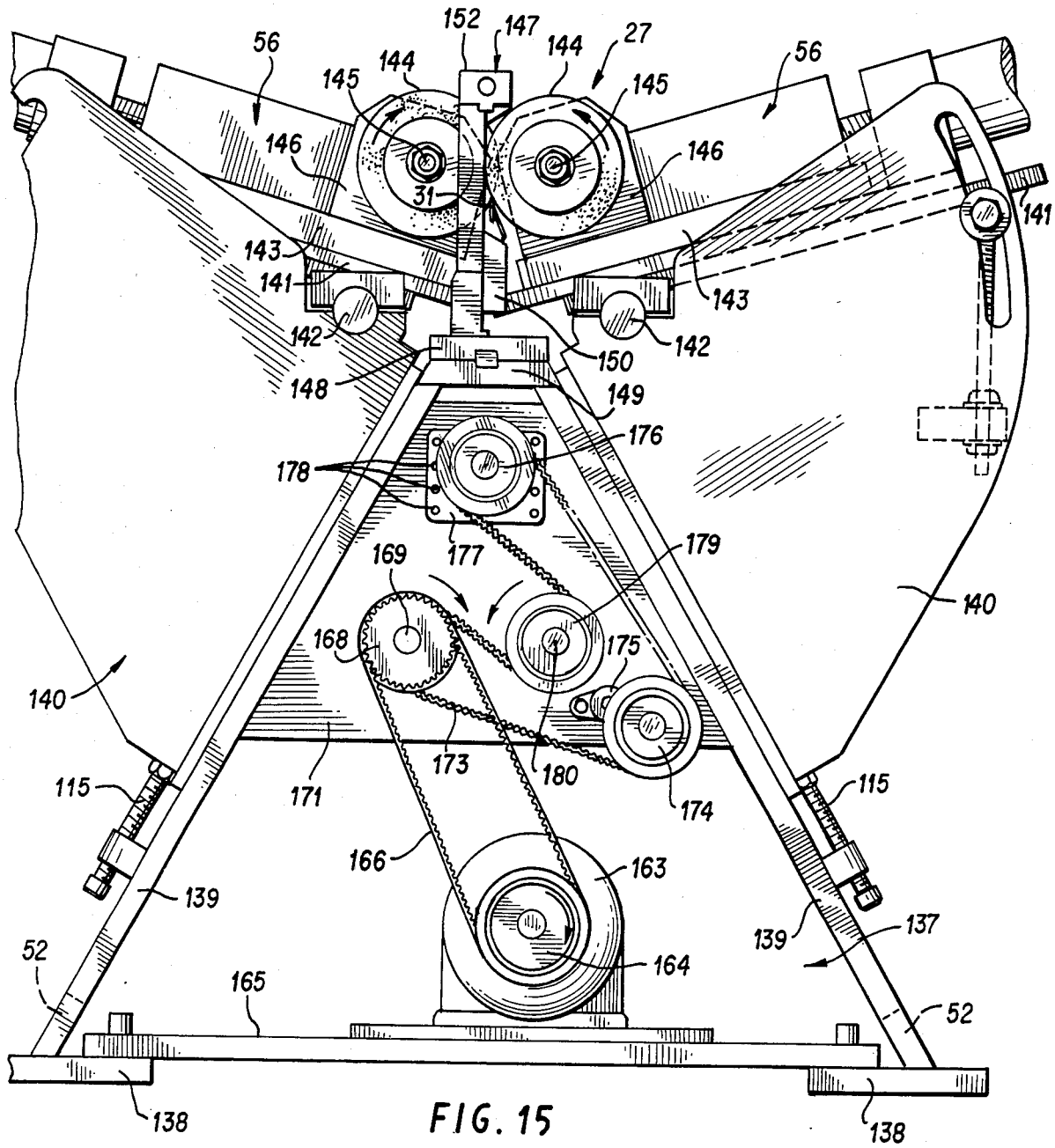
FIG. 15 is an end elevation of the hone station machine module, partly broken away.
Figure 10:
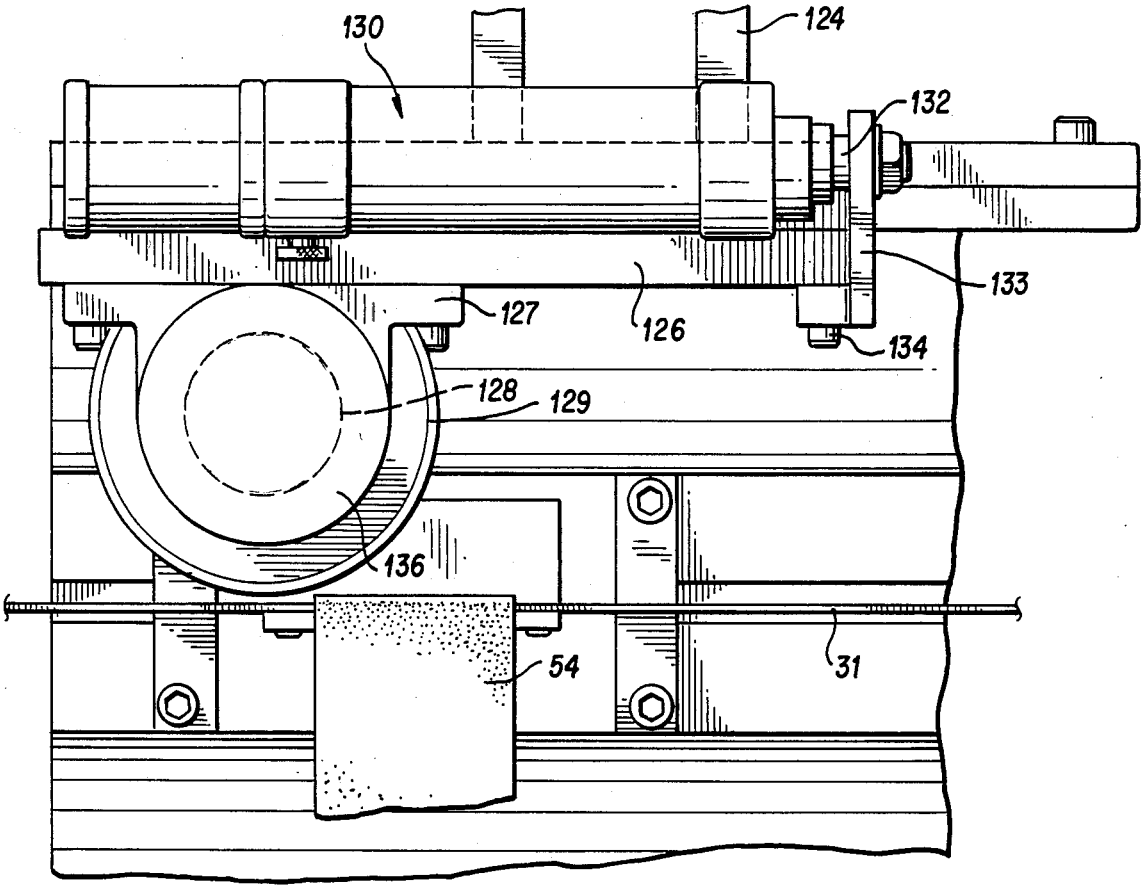
FIG. 10 is a fragmentary plan view showing a dressing wheel and a linear actuator for the dressing wheel.

The belt 173 next engages a pulley 179 carried by a shaft 180 also supported on the web 171 in spaced parallel relationship to the shaft 169 and at the same elevation as the shaft 169. The pulleys 172 and 179 engaged by the belt 173 have fixed centers. From the pulley 179, the belt 173, which is endless, returns to the pulley 172. It can be readily seen that the teeth on one side of the belt 173 engage the pulleys 172, 174 and 176, while the teeth on the opposite side of the belt 173 engage the pulley 179. The arrangement is such that the two pulleys 172 and 179 counter-rotate in unison, as shown by the directional arrows in FIG. 15, and these two pulleys have the same diameters.

Figure 9:
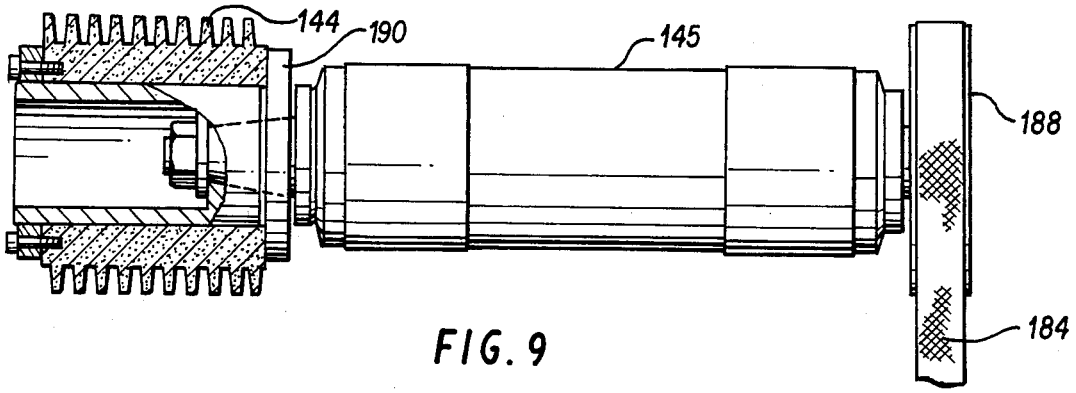
FIG. 9 is a fragmentary side elevation of a hone wheel and its spindle and associated elements, partly in vertical section.

The remainder of the drive for the honing wheels 144 an their spindles 145 is arranged exteriorly of one A-frame end plate 181. Two additional pulleys 182 and 183 on the parallel shafts 169 and 180 exteriorly of the A-frame 137 engage and drive two endless gear belts 184 and 185 which pass around the outer sides of tensioning pulleys 186 and 187 and then drivingly engage two pulleys 188 and 189 on the spindles 145 of honing wheels 144 to drive the two honing wheels in opposite directions of rotation in unison. The two honing wheels 144 have holder means 190 on the spindles 145 as shown in FIG. 9.

The tensioning pulleys 186 and 187 are operated by a vertical pneumatic tensioning cylinder 191 at the center of the A-frame 137 and supported on a rigid bracket 192 projecting therefrom. The rod 193 of tensioning cylinder 191 is connected with a pair of spreader links 194 whose outer ends are pivotally attached to a pair of arms 195 connected between the shafts 169 and 180 and the shafts 196 of belt tensioning pulleys 186 and 187.

The described gear belt drive is a soft self-compensating precision drive which eliminates all backlash in the honing wheels 144 and chatter. The same results cannot be achieved by any known positive gear drive.

All succeeding hone or hone/strop stations 28, etc. of the modular machine are identical to the described station 27 and therefore the detailed description of the station 27 serves to describe any succeeding stations of the machine, as indicated in FIGS. 1 and 2.

The gear belt drive components for the honing wheels 144 are preferably HDT Sure-Grip components manufactured by T. B. Wood's Sons Company, Chambersburg, Pa., or equivalent drive components.

It will now be apparent to those skilled in the art that during continuous movement of the blade strip 31 lengthwise through the several stations of the modular machine, the strip will be ground on the opposite sides of its top edge and, following this, will be honed or honed and stropped on both sides of its top edge. While undergoing grinding and honing, a generous amount of coolant is constantly delivered to the grinding wheels 54 and honing wheels 144 adjacent to the blade strip 31. The coolant liquid is then drained along the opposite sides of the A-frames back into the common inclined trough 38 and then into the main trough 40, as previously described.

The modular machine is simplified, compact and extremely efficient. The A-frames at the grind and hone stations and their concrete bases not only provide great resistance to vibration but the narrow tops of the A-frames provide space for the grinding and honing wheels and the diamond dressing wheel 129 and the associated infeed means.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a modular blade strip grinding and honing machine, a blade strip grind station comprising an A-frame and a rigid base supporting the A-frame, a mounting bracket fixed to the top of the A-frame, a blade strip guide and adjacent coolant delivery and discharge means on the mounting bracket, another mounting bracket on one inclined side wall of the A-frame, means to adjust and lock the last-named mounting bracket on said inclined side wall so that the height of the last-named mounting bracket relative to a blade strip in the blade strip guide can be adjusted, a plate pivotally mounted on the last-named mounting bracket and being vertically swingable, means connected with the last-named mounting bracket and said plate to adjust the angle of the plate relative to the horizontal through a range of about 15° and to lock the plate in a selected adjusted position, a precision linear slide on the plate movable toward and away from a blade strip in said guide, a grinding wheel and grinding wheel drive motor on said slide and movable therewith, a precision automatic infeed means for the grinding wheel on said slide and plate including a high resolution stepping motor and a ball screw coupled with a shaft of the stepping motor, another mounting bracket on the other inclined side wall of the A-frame, a horizontal slide on the last-named mounting bracket movable toward and away from said grinding wheel, an upstanding support bracket on the last-named slide, a precision horizontal axis slide on said support bracket and having a movement path across the axis of said horizontal slide, and a vertical axis power-driven reciprocatory dressing wheel for the face of said grinding wheel on said precision horizontal axis slide and being movable across the face of the grinding wheel near and above the blade strip guide and coolant delivery and discharge means.

2. In a modular blade strip grinding and honing machine as defined in claim 1, and said blade strip guide and adjacent coolant delivery and discharge means comprising a pair of vertically spaced parallel carbide rails on said mounting bracket fixed to the top of the A-frame engaging the lower edge of the blade strip and one side thereof, a guide plate and a pair of guide bars on the last-named mounting bracket engaging the other side of the blade strip, and a coolant manifold on the last-named mounting bracket spaced laterally of the blade strip and the face of the grinding wheel and having a plurality of vertical and horizontal coolant passages with the horizontal passages discharging coolant onto the face of the grinding wheel substantially at the top edge of the blade strip and topmost carbide rail.

3. In a modular blade strip grinding and honing machine as defined in claim 1, and said means to adjust and lock said last-named mounting bracket comprising a slotted base plate on the mounting bracket and locking screws engaging through the slots of the base plates and having threaded engagement with said inclined side wall, a height-adjusting screw for said mounting bracket engaging the lower edge thereof at the center of the mounting bracket and being threadedly engaged with a fixed element on said one inclined side wall, and a guiding key and keyway means for said mounting bracket including a keyway in the base plate of the mounting bracket near its center and a key engaging in the keyway and being doweled to said on inclined side wall of the A-frame.

4. In a modular blade strip grinding and honing machine as defined in claim 1, and said plate pivotally mounted on the last-named mounting bracket having opposite side trunnions pivotally engaged with the last-named mounting bracket, and said means to adjust the angle of said plate comprising arcuate adjusting slots in said last-named mounting bracket, a cross shaft on said plate having end portions engaged in the arcuate slots, locking nuts on the ends of the cross shaft, and a threaded eye rod pivotally connected to the cross shaft and being received through a slot formed in a fixed web of the last-named mounting bracket, and a pair of adjusting and locking nuts for the threaded eye rod disposed on opposite sides of said fixed web.

5. In a modular blade strip grinding and honing machine as defined in claim 1, and said precision linear slide on said plate comprising a cross-roller slide.

6. In a modular blade strip grinding and honing machine as defined in claim 1, and said horizontal slide comprising a dovetail slide, and a manual wheel and screw shaft to adjust the dovetail slide.

7. In a modular blade strip grinding and honing machine as defined in claim 6, and said precision horizontal axis slide comprising a cross-roller slide having its relatively movable components in a vertical plane.

8. In a modular blade strip grinding and honing machine as defined in claim 1, and a linear actuator connected with said dressing wheel to reciprocate it horizontally across the face of the dressing wheel.

9. In a modular blade strip grinding and honing machine as defined in claim 8, and the linear actuator comprising a horizontal axis air-hydraulic cylinder.

10. In a modular blade strip grinding and honing machine as defined in claim 1, and said dressing wheel including a vertical axis motor-driven spindle carried by said precision horizontal axis slide.

11. A modular blade strip grinding and honing machine comprising a plurality of stations including a left hand and a right hand grind station and at least one hone station, each grind and hone station of the machine including an independent frame member, a supporting base to which each frame member is anchored and underlying and being common to all of the frame members and being provided with a coolant drainage passage receiving coolant discharged near the bottom of each frame member, a blade strip guide and coolant delivery means on the top of each frame member, a grinding wheel, grinding wheel drive means and grinding wheel infeed means adjustably mounted on one side of each frame member at each grind station of the modular machine, a reciprocatory power-operated grinding wheel face dressing wheel adjustably mounted on the other side of each frame member of each grind station, a pair of parallel axis spiral interlocked honing wheels adjustably mounted on opposite sides of each frame member at each hone station and including honing wheel infeed means, the honing wheels having spindles, and a gear belt drive for the spindles of the honing wheels including a pair of motor driven fixed axis horizontal parallel drive shafts on and within said frame member and having end portions extending exteriorly of one end wall of the frame member, a pair of gear belt drive pulleys on said drive shafts within the frame member, another pair of pulleys on the end portions of said drive shafts exteriorly of the frame member, a drive belt drivingly interconnecting a motor output shaft with one of said fixed axis horizontal parallel drive shafts a gear belt having gear belt teeth on both sides thereof engaged with said pair of gear belt drive pulleys within the frame member, an adjustable axis idler pulley engaged with said gear belt within the frame member below said pair of gear belt drive pulleys, another idler pulley within the frame member near the top thereof and above said pair of gear belt drive pulleys within the frame member and also being engaged with said gear belt having said teeth on both sides thereof, and a pair of endless honing wheel spindle pulley toothed drive belts connected with said another pair of pulleys and being driven thereby to counter rotate the honing wheels, and constant tensioning means for said pair of spindle pulley drive belts comprising a pair of gear belt tensioner pulleys exteriorly of the frame member engaged with said pair of endless drive belts, a belt tensioner cylinder and linkage means connected with said belt tensioner pulleys exteriorly of said one end wall of the frame member, backlash and chatter of the honing wheels being eliminated thereby.

12. A modular blade strip grinding and honing machine as defined by claim 11 herein said spindles comprise elongated overhanging horizontally oriented spindles mounted on said infeed means.

13. A modular blade strip grinding and honing machine as defined in claim 11, and said supporting base comprising a concrete base having embedded therein a pair of spaced parallel beams on which bottom plates of the frame members of the machine stations are fixedly mounted.

14. A modular blade strip grinding and honing machine as defined in claim 11, and a mounting bracket for said grinding wheel, grinding wheel drive means and infeed means on one side wall of each frame member at each grind station, means connected with said mounting bracket to adjust and lock it on said side wall to raise and lower the elevation of the grinding wheel, and means on said mounting bracket and being pivotally connected therewith to adjust the angle of the grinding wheel, grinding wheel drive means and said infeed means relative to one side of a blade strip.

15. A modular blade strip grinding and honing machine as defined in claim 14, and said grinding wheel infeed means comprising a cross-roller slide on the last-named means, a stepping motor and ball screw on the cross-roller slide connected with said grinding wheel, and a grinding wheel drive motor means on the cross-roller slide.

16. A modular blade strip grinding and honing machine as defined in claim 14, and another mounting bracket attached to the other side wall of each frame member at each grind station, a horizontal dovetail slide on the last-named mounting bracket having a movement axis across the top of the frame member toward and away from the grinding wheel, a support bracket on the dovetail slide, a vertical axis diamond dressing wheel for the face of the grinding wheel and including a motor-driven spindle, a holding means for said spindle, a horizontal axis cross-roller slide connected between said holder and said support bracket, and a horizontal axis linear power actuator connected between said holding means for said spindle and a movable component of the last-named cross-roller slide.

17. In a modular blade strip grinding and honing machine, a blade strip hone station comprising a frame and a rigid base supporting the frame, a support fixed to the top of the frame, a blade strip guide mount and adjacent coolant delivery means on said support, a pair of mounting brackets one on each inclined side wall of the frame, a vertically swingable pivot plate mounted on each mounting bracket, adjustable means connected between each pivot plate and mounting bracket to adjust the angle of the pivot plate relative to the horizontal through a range of about 30? and to lock each pivot plate in a selected angularly adjusted position, a precision slide on each pivot plate movable toward and away from said blade strip guide mount, a pair of parallel axis spiral interlocked honing wheels an infeed means for the honing wheels on said precision slides and being movable therewith, and a gear belt drive means on said frame connected with spindles of said honing wheels to turn the latter in opposite directions in unison, said gear belt drive means further including a drive motor within said frame, a pair of parallel fixed axis drive shafts journaled on the frame and extending interiorly and exteriorly thereof, a pair of drive pulleys on one end of said parallel fixed axis drive shafts within the frame, another drive pulley on the other parallel fixed axis drive shaft within the frame, another pair of drive pulleys on the parallel fixed axis drive shaft exteriorly of the frame, an idler pulley within the frame near the top thereof above and between said parallel fixed axis drive shafts, another idler pulley within the frame near the bottom thereof and below the parallel fixed axis drive shafts, a gear belt having teeth on one side thereof drivingly interconnecting the shaft of said motor with one of the drive pulleys on said one parallel fixed axis drive shaft, a gear belt having teeth on opposite sides thereof engaged with the other drive pulley on said one parallel fixed axis shaft and being also engaged with said idler pulleys and the drive pulley on the other parallel fixed axis shaft within the frame, and a second pair of gear belts connected with the spindles of said honing wheels and with said another pair of pulleys on the parallel fixed axis shafts exteriorly of the frame, and tensioning means for the last-named pair of gear belts connected with the spindles on the exterior of the frame, whereby backlash and chatter of the honing wheels is eliminated.

18. In a modular blade strip grinding and honing machine as defined in claim 17, and the parallel axes of said honing wheels being above and parallel to the swing axes of the pivot plates.

19. In a modular blade strip grinding and honing machine as defined in claim 17, and said tensioning means including a pneumatic cylinder, and a linkage operatively connected with said cylinder and with a pair of tensioning pulleys engaged with the last-named pair of gear belts.

20. In a honing machine having interlocking honing wheels, a gear belt drive for the honing wheels including a drive motor, a pair of parallel fixed axis drive shafts journaled on a frame of the honing machine, a first pair of drive pulleys on one of said parallel fixed axis drive shafts, another drive pulley on the other parallel fixed axis shaft next to said first pair of drive pulleys, a second pair of drive pulleys on the parallel fixed axis drive shafts remote from said first pair of drive pulleys and said another drive pulley, a first idler pulley adjacent said first pair of drive pulleys and said another drive pulley above and between said parallel fixed axis drive shafts, a second idler pulley below and to the side of the parallel fixed axis drive shafts, a gear belt having teeth on one side thereof drivingly interconnecting the shaft of said motor with one of said first pair of drive pulleys on said one parallel fixed axis shaft, a gear belt having teeth on both sides thereof engaged with the other of said first pair of drive pulleys on said one parallel fixed axis shaft and also being engaged with said idler pulleys and said another drive pulley on the other parallel fixed axis shaft, and another pair of gear belts further being drivingly connected with the honing wheels by being engaged with said second pair of pulleys on the parallel fixed axis shafts.

21. In a honing machine as defined by claim 20 and additionally including means for providing constant tensioning of the second pair of gear belts, said tensioning means comprising a pneumatic cylinder, a pair of tensioning pulleys engaging said second pair of gear belts and a spreader linkage connected between said cylinder and tensioning pulleys whereby backlash and chatter of the honing wheels are eliminated.

22. In a modular strip grinding and honing machine as defined by claim 20 wherein one of said idler pulleys comprises an adjustable axis idler pulley.

23. In a modular blade strip grinding and honing machine as defined in claim 20 wherein said frame comprises an A-frame assembly.

24. In a honing machine having interlocking honing wheels and infeed means therefor, respective spindles located on said infeed means and being connected to the honing wheels, a gear belt drive for the honing wheels including a drive motor, a pair of parallel fixed axis drive shafts journaled on a frame of the honing machine, a first pair of drive pulleys on one of said parallel fixed axis drive shafts, another drive pulley on the other parallel fixed axis drive shaft next to said first pair of drive pulleys, a second pair of drive pulleys on the parallel fixed axis drive shafts remote from said first pair of drive pulleys and said another drive pulley, a first idler pulley adjacent said first pair of drive pulleys and said another drive pulley above and between said parallel fixed axis drive shafts, a second idler pulley below and to the side of the parallel fixed axis drive shafts, a gear belt having teeth on one side thereof drivingly interconnecting the shaft of said motor with one of said first pair of drive pulleys on said one parallel fixed axis shaft, a gear belt having teeth on opposite sides thereof engaged with the other of said first pair of drive pulleys on said one parallel fixed axis shaft and being also engaged with said idler pulleys and said another drive pulley on the other parallel fixed axis shaft, another pair of gear belts connected to and driving the spindles connected to the honing wheels by being engaged with said second pair of pulleys on the parallel fixed axis shafts, and tensioning means for the second pair of gear belts comprising a pneumatic cylinder, a pair of tensioning pulleys engaging said second pair of gear belts and a spreader linkage connected between said cylinder and said tensioning pulleys whereby backlash and chatter of the honing wheels are eliminated.

25. In a honing machine as defined by claim 24 wherein said spindles comprise elongated cantilevered horizontally oriented spindles mounted on said infeed means.

* * * * *